US008408021B2

(12) United States Patent
Cha et al.

(10) Patent No.: US 8,408,021 B2
(45) Date of Patent: Apr. 2, 2013

(54) INDOOR UNIT OF AIR CONDITIONER

(75) Inventors: Sang Won Cha, Suyeong-gu (KR); Tae Jun Park, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 604 days.

(21) Appl. No.: 12/086,483

(22) PCT Filed: Nov. 30, 2006

(86) PCT No.: PCT/KR2006/005136

§ 371 (c)(1),
(2), (4) Date: Jul. 20, 2010

(87) PCT Pub. No.: WO2007/091766

PCT Pub. Date: Aug. 16, 2007

(65) Prior Publication Data

US 2010/0287966 A1 Nov. 18, 2010

(30) Foreign Application Priority Data

Feb. 7, 2006 (KR) ..... 10-2006-0011652
Mar. 10, 2006 (KR) ..... 10-2006-0022777

(51) Int. Cl.
*F25D 23/12* (2006.01)

(52) U.S. Cl. ..... 62/263

(58) Field of Classification Search ..... 62/263
See application file for complete search history.

(56) References Cited

U.S. PATENT DOCUMENTS

| | | | | |
|---|---|---|---|---|
| 4,583,309 | A * | 4/1986 | Kane et al. | 40/711 |
| 4,733,542 | A * | 3/1988 | Blair | 62/263 |
| 6,018,955 | A | 2/2000 | Kancko et al. | |
| 2003/0145618 | A1 | 8/2003 | Moon et al. | |

FOREIGN PATENT DOCUMENTS

| | | | |
|---|---|---|---|
| CN | 2663862 | Y | 12/2004 |
| CN | 1712791 | A | 12/2005 |
| EP | 1 271 065 | A2 | 1/2003 |
| JP | 06 174255 | A | 6/1994 |
| JP | 7-248126 | A | 9/1995 |
| JP | 2000 111082 | A | 4/2000 |
| JP | 2004 077052 | A | 3/2004 |
| JP | 2004 340491 | A | 12/2004 |
| KR | 10-2005-0078536 | A | 8/2005 |
| KR | 10-2006-0010086 | A | 2/2006 |
| WO | WO 03/014628 | A2 | 2/2003 |

* cited by examiner

*Primary Examiner* — Melvin Jones
(74) *Attorney, Agent, or Firm* — McKenna Long & Aldridge LLP

(57) ABSTRACT

The present invention relates to a picture frame type indoor unit of an air conditioner for mounting a photograph or a picture on a wall. The indoor unit of an air conditioner includes a cabinet (10), a picture frame panel (30) mounted in front of the cabinet (10), and a link mechanism (200) hinged both on the cabinet (10) and the picture frame panel (30), thereby permitting convenient working in inside inspection or repair of the indoor unit even if the picture frame panel (30) is not dismounted from the cabinet (10) completely.

21 Claims, 14 Drawing Sheets

(a)

(b)

INDOOR UNIT OF AIR CONDITIONER

This application is a 371 national stage filing of International Application No. PCT/KR2006/005136, filed Nov. 30, 2006 and claims priority to Korean Application No. 10-2006-0011652, filed Feb. 7, 2006 and Korean Application No. 10-2006-0022777, filed Mar. 10, 2006, each of which are incorporated by reference in their entireties, as if fully set forth herein.

TECHNICAL FIELD

The present invention relates to a picture frame type indoor unit of an air conditioner for mounting a photograph or a picture on a wall.

BACKGROUND ART

In general, the air conditioner, serving as a room heater, a room cooler, or an air purifier for cooling/heating a room, or purifying room air, provides human being a better room environment. Recently, an air conditioner has been developed, which is provided with a turbo-fan to minimize a thickness of a cabinet thereof to permit the air conditioner to be mounted on a wall of the room like a picture frame.

FIG. 23 illustrates an exploded perspective view of a related art air conditioner.

Referring to FIG. 23, the related art air conditioner is provided with a thin rectangular cabinet 1 with an opened front, a fan 2 in the cabinet 1, a heat exchanger 3 in front of the fan 2, a front panel 4 with an air inlet 4*a* in front of the heat exchanger 3, an orifice 5 which is an air outlet between the cabinet 1 and the front panel 4, and a front grill 6 rotatably mounted in front of the front panel 4, for opening/closing the air inlet 4*a*.

The fan 2 is provided with a turbo fan 2*a* and a motor 2*b* for rotating the turbo fan 2*a*, not only for minimizing thickness of the cabinet 1, but also for discharging air drawn through the air inlet 4*a* in a circumferential direction.

The orifice 5, between the heat exchanger 3 and the fan 2, guides the air from the air inlet 4*a* to the fan 2.

In the meantime, mounted between the front panel 4 and the orifice 5, there is a filter 7 for filtering air from the air inlet 4*a*, and mounted above the orifice 5, there is a control box 8 which is a control unit.

Mounted on the cabinet 1, there are outlet units 9 for guiding a direction of air blow at the time of air discharge from an inside of the cabinet 1.

The outlet unit 9 has an air outlet on an inner side with a plurality of grills 9*a* for guiding an air blow direction, and a motor (not shown) for operating vanes 9*b*.

However, the related art indoor unit of an air conditioner has a problem in that the front grill and the front panel are required to be dismounted/mounted from/to the cabinet completely in cleaning or repair of the indoor unit, which requires a long working time.

DISCLOSURE OF INVENTION

Technical Problem

An object of the present invention devised to solve the problem lies on providing an indoor unit of an air conditioner, which enables secure setting and opening of a picture frame panel which is a front of the indoor unit for convenience of cleaning and repair of an inside of the cabinet.

Technical Solution

To achieve these objects and other advantages and in accordance with the purpose of the invention, as embodied and broadly described herein, an indoor unit of an air conditioner includes a cabinet, a picture frame panel mounted in front of the cabinet, and a link mechanism hinged both on the cabinet and the picture frame panel.

Advantageous Effects

The indoor unit of an air conditioner of the present invention permits to make a secure setting and opening of a picture frame panel which is a front of the indoor unit for convenience of cleaning and repair of an inside of the cabinet.

Moreover, the picture frame panel can be mounted/dismounted to the cabinet, conveniently.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
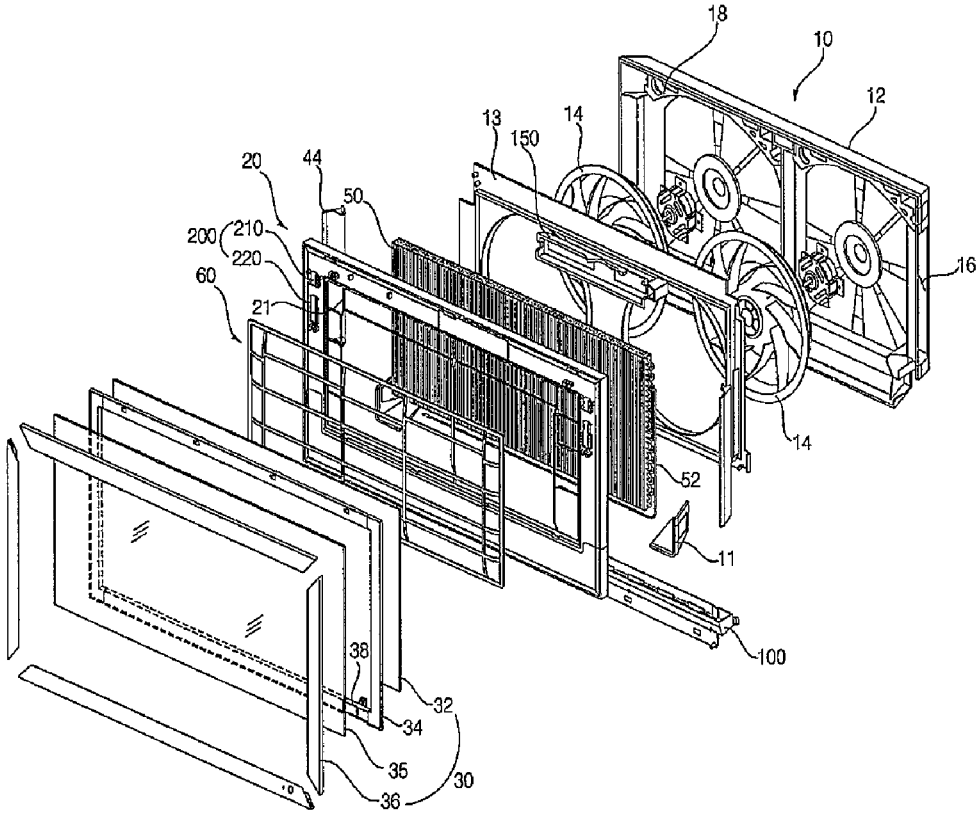
FIG. 1 illustrates an exploded perspective view of an indoor unit of an air conditioner in accordance with a preferred embodiment of the present invention.
Figure 2:
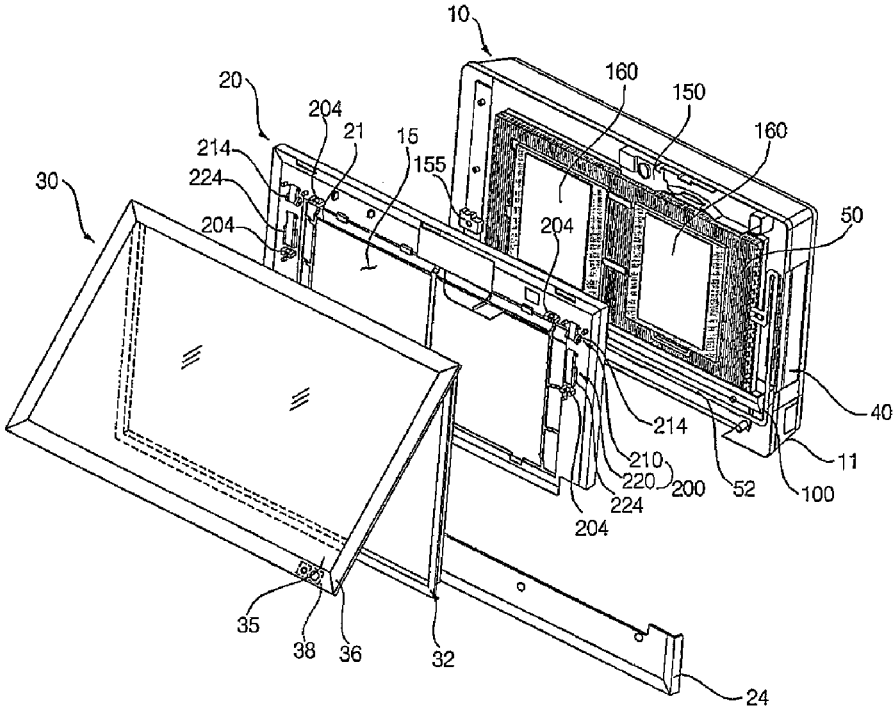
FIG. 2 illustrates an exploded perspective view of an inside of an indoor unit of an air conditioner in accordance with a preferred embodiment of the present invention.
Figure 3:
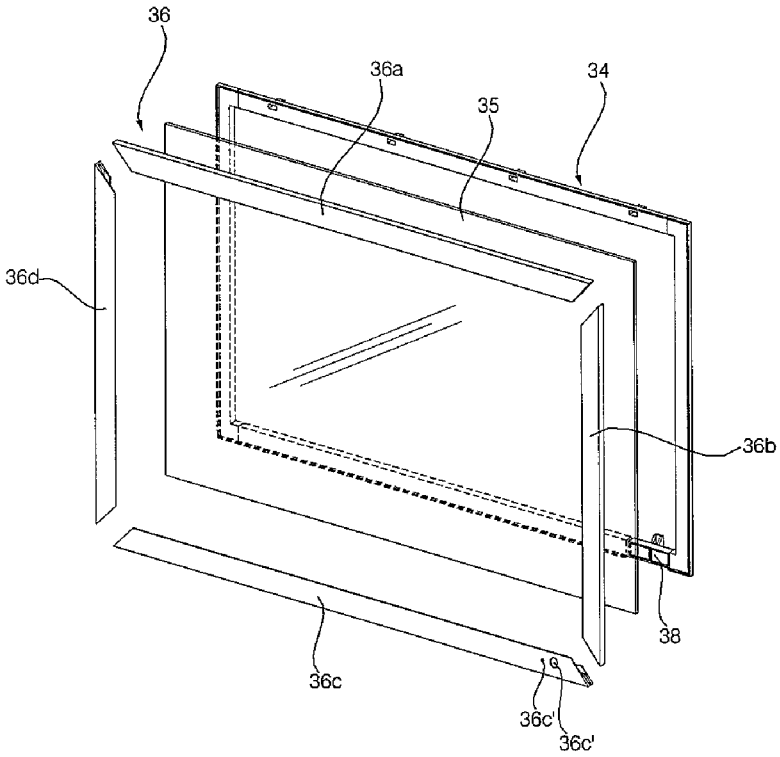
FIG. 3 illustrates an exploded perspective view of a picture frame panel in accordance with a preferred embodiment of the present invention.
Figure 4:
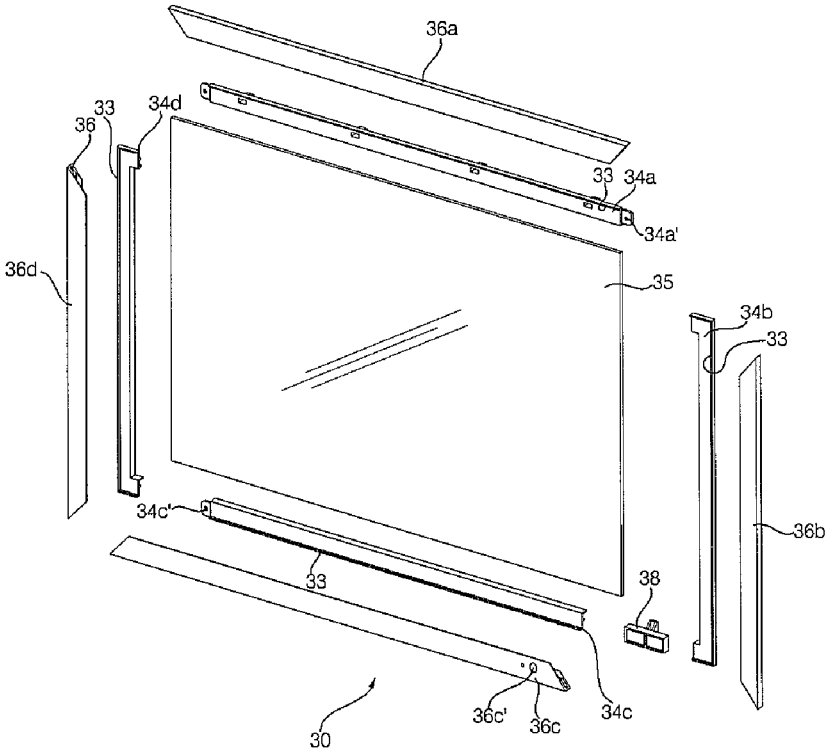
FIG. 4 illustrates an exploded perspective view of a deco-frame of a picture frame panel of the present invention.
Figure 5:
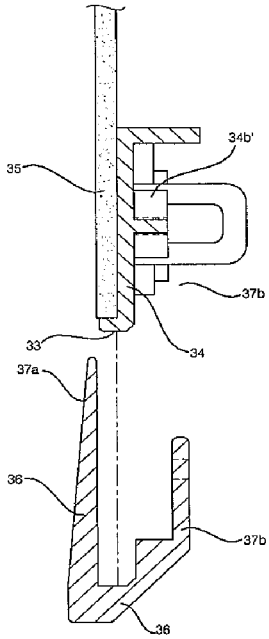
FIG. 5 illustrates sections showing the steps of a process for assembling a picture frame panel in accordance with a preferred embodiment of the present invention.
Figure 5:
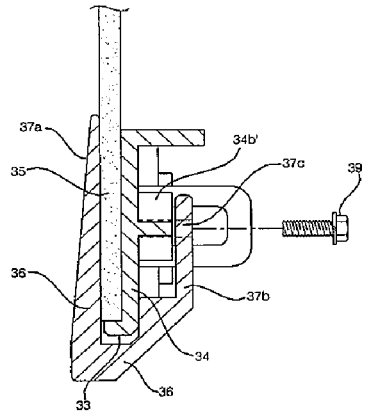
Figure 6:
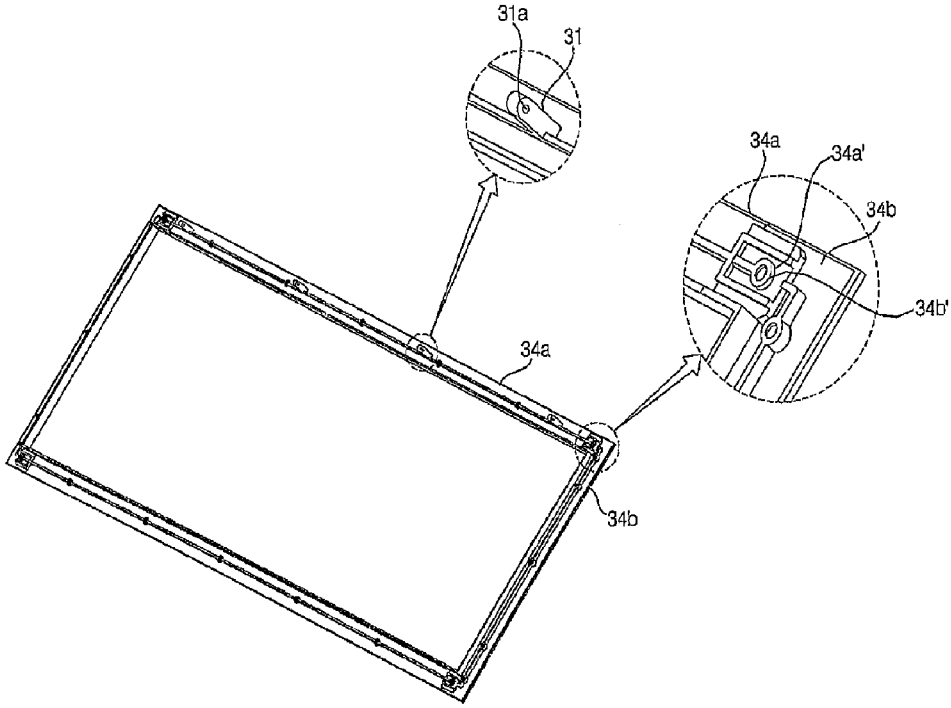
FIG. 6 illustrates a perspective view of a deco-frame with fastening portions in accordance with a preferred embodiment of the present invention.
Figure 7:
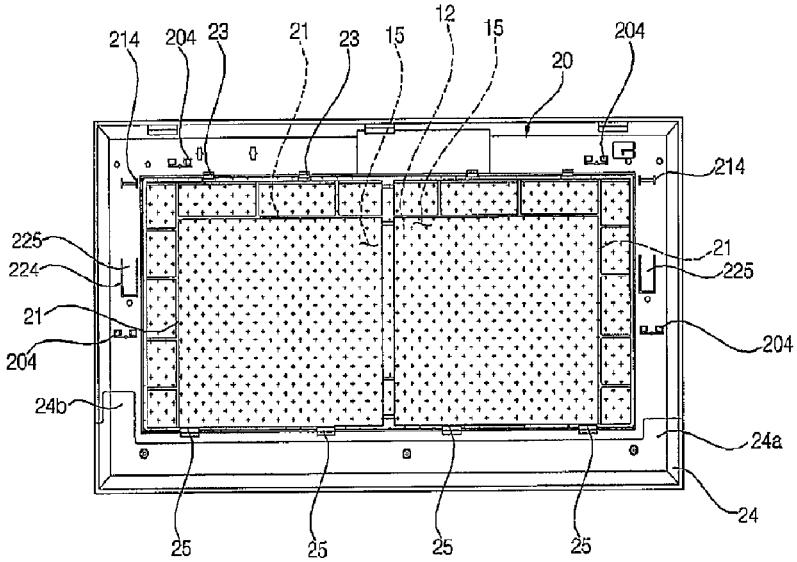
FIG. 7 illustrates a front view of a front panel in accordance with a preferred embodiment of the present invention.
Figure 8:
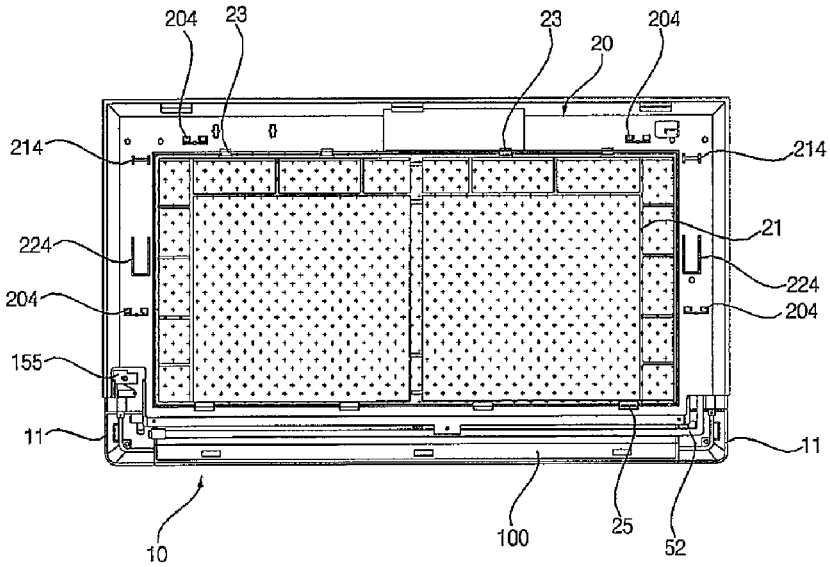
FIG. 8 illustrates a front view of a front panel in accordance with a preferred embodiment of the present invention, having a service cover removed therefrom.

Referring to FIG. 1 or 2, the indoor unit of an air conditioner in accordance with a preferred embodiment of the present invention includes a cabinet 10 forming an exterior of the indoor unit, a front panel 20 mounted to a front of the cabinet 10, and a picture frame panel 30 mounted to the front panel 20 with a space thereto.

The front panel 20 has a central air inlet 15, and is fastened to the cabinet 10.

The cabinet 10 has at least one air outlet 16 for discharge of air.

The picture frame panel 30 is mounted in front of the front panel 20, spaced a pre-determined distance from the front panel 20 to form a gap through which air moves toward the air inlet 15.

In the meantime, the indoor unit includes a base 12 to be mounted on a wall of a room, a fan 14 on the base 12 for drawing/discharging room air, and an orifice 13 for guiding air from the air inlet 15 to the fan 14.

The fan 14 between the base 12 and the orifice 13 guides the air from the air inlet 15 to the air outlet 16 entirely.

Particularly, the fan 14 is a centrifugal fan for discharging air from the orifice 13 in a circumferential direction.

On opposite sides of the fan 14, i.e., in opposite sides of the base 12, there are the air outlets 16 for guiding air from the fan 14 to an outside of the cabinet 10. Each of the air outlets 16 has an outlet unit 40 mounted thereon for opening/closing the air outlet 16.

The air outlet 16 on an underside of the base 12 also has the outlet unit 40 mounted thereon for guiding outlet air into the room opened/closed by the control unit of the indoor unit.

The base 12 is fixedly secured to the wall of the room with a bracket on a back side.

Mounted over the fan 14, i.e., at an upper portion of the base 12, there is an air guide 18 for guiding the air from the fan 14 to the air outlets 16 on both sides of the base 12.

In the meantime, mounted over the orifice 13, there is an outfit unit 150 of the control unit of the air conditioner.

In front of the orifice 13, there is a heat exchanger 50 for making heat exchange with room air for cooling/heating the room air, and under the heat exchanger 50, there is a drain pan 100 for holding and draining condensed water formed at the heat exchanger 50.

The heat exchanger 50 is secured to the front panel 20 or the orifice 13, and has a connection pipe 52 at one side for connection to a refrigerant pipe line (not shown) lead from an outside of the indoor unit.

Particularly, the heat exchanger 50 has a plasma filter 160 on a front.

The front panel 20 in front of the heat exchanger 50 is fastened to the base 12. The fastening of the front panel 20 to the base 12 forms the air outlet 16 on which the outlet unit 40 is mounted.

The cabinet 10 has pipe covers 11 mounted on corners to form a portion of an exterior of the indoor unit as the pipe covers 11 are mounted to corners of the base 12.

The pipe covers 11 are mounted to a plurality of corners of the four corners of the cabinet 10, through which the external refrigerant pipe line is lead into the cabinet 10.

In the meantime, referring to FIGS. 2 to 6, the picture frame panel 30 includes a picture frame base 32, and a picture frame assembly rotatably hinged on the picture frame base 32.

The picture frame assembly includes a deco-frame 34 hinged on the picture frame base 32, a transparent plate 35 placed in the deco-frame 34, a deco 36 for surrounding and holding the deco-frame 34 and the transparent plate 35 at a time, and a display window 38 in the deco-frame 34.

The transparent plate 35 is formed of transparent acryl, or glass, and positioned on a front of the picture frame base 32 for exposing a picture or a photograph attached to the picture frame base 32.

The deco-frame 34 is mounted on a periphery of the transparent plate 35 for securing the transparent plate 35.

The deco-frame 34 includes four members 34*a*, 34*b*, 34*c*, and 34*d* for making close contact to four sides of the transparent plate 35, each of which are assembled together before mounting.

Accordingly, some members 34*a* and 34*c* of the deco-frame 34 have holes 34*a*' and 34*c*' respectively and other members 34*b* and 34*d* have bosses 34*b*' to be placed in the holes 34*a*' and 34*c*' respectively. A fastening member (not shown) is fastened to the boss 34*b*' after the deco 36 is assembled, to put the deco-frame 34 close to the deco 36.

Together with this, the members 34*a*, 34*b*, 34*c*, and 34*d* of the deco-frame 34 have outer edges 33 bent forward for surrounding an edge of the transparent plate 35.

On an upper side of a back side of the deco-frame 34, there are projections 31 toward the picture frame base 32, each with a hinge hole 31*a* for hinge connection to the picture frame base 32.

The hinge hole 31*a* is extended in a lateral direction at an upper side of the deco-frame 34 so that the picture frame assembly can turn around a top edge.

The projection 31 connects the picture frame base 32 to the picture frame assembly with a hinge as the projection is placed in a slot (not shown) in the picture frame base 32 and a pin (not shown) is passed through the slot and the projection 31.

On a lower side of the deco-frame 34, there is the display window 38 connected to the outfit unit 150 for displaying a signal.

The display window 38 between a lower side member 34*c* and a right side member 34*b* of the deco-frame 34 is mounted at a lower side of a right side of the drawing, and the lower member 36*c* of the deco 36 has a hole 36*c*' for exposing the display window 38.

Though the embodiment shows the display window 38 as a device for turning on an LED or the like, different from this, the display window 38 may be a flat display unit, such as an LCD.

The display window 38 displays an operation state of the indoor unit, or an environment of the room, or the like.

In the meantime, the deco 36, for surrounding and holding edges of the deco-frame 34 and the transparent plate 35 at a time, has one opened side facing the transparent window.

The deco 36 has four members 36*a*, 36*b*, 36*c*, and 36*d* for surrounding four edges of the transparent plate 35 at a time.

In grooves 37 in the members 36*a*, 36*b*, 36*c*, and 36*d*, the deco-frame 34 and the transparent plate 35 are placed.

Particularly, a front side blade 37*a* of the deco 36 is made to be in close contact with the transparent plate 35, and a rear side blade 37*b* of the deco 36 is made to be in close contact with the deco-frame 34.

The rear side blade 37*b* of the deco 36 is formed long enough to cover the hole 34*a*'/boss 34*b*' portions to which the members 36*a* and 36*b* of the deco-frame 34 are engaged.

The rear side blade 37*b* of the deco 36 has a hole 37*c* for placing a fastening member 39 therein, and the fastening member 39 placed through the hole 37*c* of the deco 36 is placed in the boss 34*b*' of the deco-frame 34 after the fastening member 39 is placed through the hole 37*c*. As an inserted depth of the fastening member 39 becomes the deeper, the fastening member 39 presses the deco-frame 34 onto the transparent plate 35.

The hole 37*c* in the deco 36 has a thread formed thereon for fastening with the fastening member 39, and an end of the fastening member 39 pushes the deco-frame 34 toward the transparent plate 35.

The front side blade 37*a* of the deco 36 is long enough to make the deco-frame 34 invisible through the transparent plate 35, the hole 36*c*' in the deco 36 matches with the display window 38.

Assembly of the picture frame panel 30 of the present invention is efficient because the fastening member 39 presses the deco-frame 34 onto the transparent plate 35 at the time the fastening member 39 is fastened, and fastening of the deco 36 and the deco-plate 34 is made at a time.

The front panel 20 includes the air inlet 15 at a center, and a service cover 24 under the air inlet 15 for covering a portion of an inside of the cabinet 10. The service cover 24 is a portion of an exterior of the front panel 20.

The service cover 24 is detachably mounted on the front panel 20 with a hook 27*a* and a hole 17*a*. The service cover 24 and the drain pan 100 are fastened together and is fastened to the front panel 20 with a bolt (not shown) or a screw (not shown).

Particularly, the service cover 24 is fastened to the front panel 20, such that one end 24*a* thereof is positioned in front of a lower connection pipe 52 of the heat exchanger for covering the connection pipe 52, and the other end covers a terminal box 155 for supplying power to the outfit unit 150.

The terminal box 155 is separate from the outfit unit 150, and connected with cable for supplying power.

Particularly, the terminal box 155, covered with the service cover 14, can be repaired only after removing the service cover 24 instead of removing the front panel 20 entirely, in a case repair of the terminal box 155 is required.

Moreover, at the time of installation of the indoor unit, after removing, not the front panel 20 entirely, but only the service cover, the refrigerant pipeline is connected to the heat exchanger, and the cable is connected to the terminal box 155, thereby simplifying the installation of the indoor unit.

Figure 9:
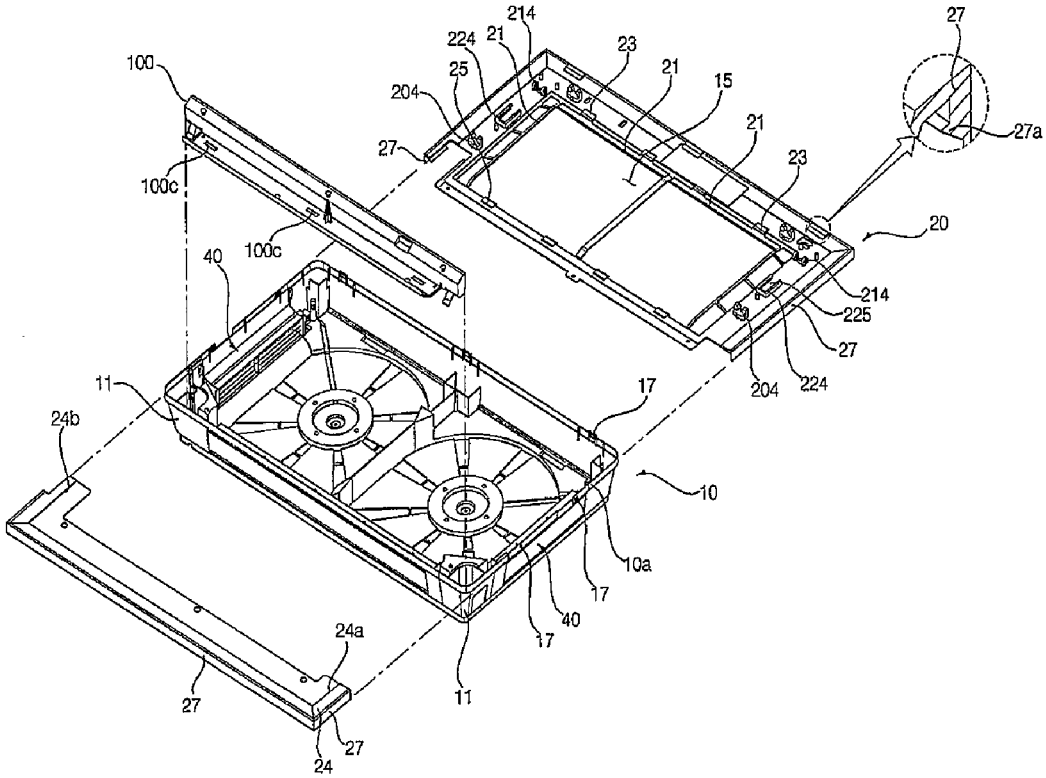
FIG. 9 illustrates an exploded perspective view of a cabinet and a front panel in accordance with a preferred embodiment of the present invention.
Figure 10:
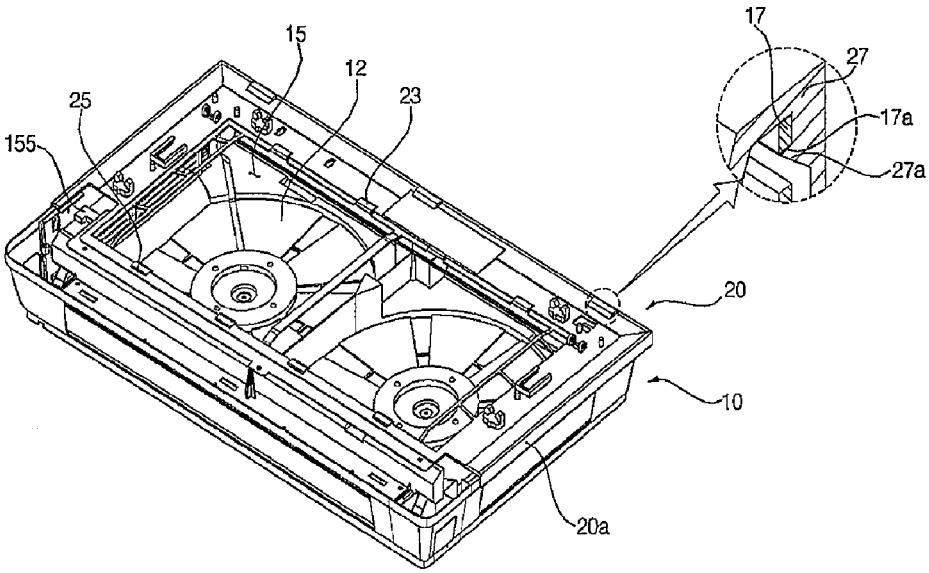
FIG. 10 illustrates a perspective view a cabinet and a front panel assembled together in accordance with a preferred embodiment of the present invention.
Figure 11:
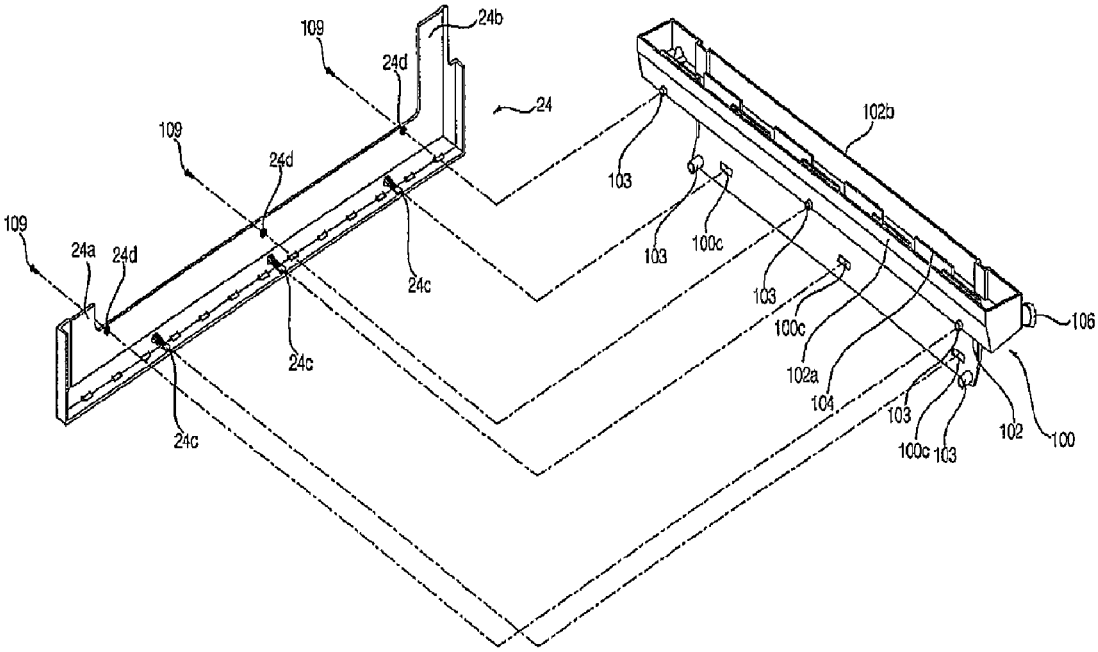
FIG. 11 illustrates a perspective view of a service cover and a drain pan in accordance with a preferred embodiment of the present invention.

Referring to FIG. 9 or 10, the cover portion 27 of the front panel 20 is bent backward to cover a front side edge of the cabinet 10.

The cabinet 10 has a rim 17 at a front side edge covered with the front panel 20, such that the rim 17 is inserted in the cover portion 17.

Particularly, in the embodiment, the hook 27*a* on an inside surface of the cover portion 27 of the front panel 20 and the hole 17*a* on the rim 17 of the cabinet 10 are engaged at the time the front panel 20 is mounted on the cabinet 10, such that the front panel 20 covers the rim 17 of the cabinet 10.

Thus, the front side edge of the cabinet 10 is covered with, and secured to the cover portion 27 which is a rear side edge of the front panel 20, such that a line of coupling of the cabinet 10 and the front panel 20 are not shown on the exterior of the indoor unit.

That is, the cover portion 27 is mounted to cover the rim 17 entirely, not to expose the rim 17, but to expose the cover portion 27 on the exterior of the indoor unit.

Accordingly, since the coupling line of the cabinet 10 and the front panel 20 is not exposed, the indoor unit has a simple exterior, to prevent the coupling line from becoming dirt with dust or impurity.

Moreover, since the front panel 20 covers an outside of the cabinet 10, the indoor unit of the present invention has a flatness improved at the coupling portion of the front panel 20 and the cabinet 10.

That is, if the coupling line is exposed to the exterior, the exterior appears elegant only when abutting surfaces of the front panel 20 and the cabinet 10 are continuous, if not, the flatness of the exterior appears poor. However, in the present invention, since the front panel 20 covers an outside of the cabinet 10, the flatness or a coupling state of the coupling line is not required to take into account, which increases freedoms of design.

In the meantime, the front panel 20 has a front grill 21 (see FIG. 1) on the front thereof, and the air inlet 15 has a filter 60 mounted thereon for filtering air flowing toward the orifice 13.

The front grill 21 is extended from the front panel 20 toward a center side of the air inlet 15 limited to a portion of a circumference of the air inlet 15.

The front grill 21 is projected forward from the front panel 20 toward the picture frame panel 30.

The filter 60 is detachably mounted on the front panel 20. In this instance, the filter 60 has a lower edge inserted in a slot 25 in the front panel 20, and an upper edge inserted in a holding slot 23.

The filter 60 is projected forward by a predetermined distance in conformity with the front grill 21 projected toward the picture frame panel 30. In the embodiment, the filter 60 has a circumference of the filter 60 attached to a circumference of the air inlet 15, and a central portion only bulged forward.

The central bulge of the filter 60 suppresses the filter 60 from being in contact with the heat exchanger 50 in a back side of the filter 60, and provides the filter 60 with a greater area compared to a planar filter.

The service cover 24 of the present invention covers a lower outside circumference of the cabinet 10 fastened, and secured to the drain pan 100.

The service cover 24 has hooks 24*c* each projected from the back side toward the drain pan 100, and the drain pan 100 has slots 100*c* for placing the hooks 24*c* therein respectively.

Moreover, the service cover 24 is fastened to the drain pan 100 with fastening members 109 through fastening holes 24*d* in the service cover 24 and bosses 103 on the drain pan 100.

The drain pan 100 includes a housing 102, ribs 104 in the housing 102, and a drain pipe 106 for draining condensed water from the housing 102 to an outside of the indoor unit.

The housing 102 is a hexahedral box with an opened top. The heat exchanger 50 (see FIG. 1) is seated in the housing 102.

Particularly, the housing 102 has a top edge of a front wall 102*a* higher than a top edge of a rear wall 102*b* for reducing resistance of air passing through the heat exchanger 50.

The ribs 104 in the housing 102 are vertical to support a bottom of the heat exchanger 50.

The rib 104 is a thin plate extended in a lateral direction for lateral contact with the bottom of the heat exchanger 50 which is mounted in the lateral direction.

Particularly, the ribs 104 are formed to guide the condensed water toward the drain pipe 106.

The plurality of ribs 104 are arranged in a zigzag form for smooth movement of the condensed water from the housing 102 to the drain pipe 106 at a side of the service housing 102.

The rib 104 has a height lower than the top edges of the front wall 102*a* or the rear wall 102*b* of the housing 102, so that the front wall 102*a* or the rear wall 102*b* supports the front of rear of the heat exchanger 50.

The drain pipe 106 passes through the housing 102, and has an end on an outside of the housing 102 with a condensed water hose (not shown) connected thereto for guiding the condensed water from the housing 102 to an outside of the room.

Following one-touch action of the user to activate a link mechanism, the picture frame panel 30 can move forward of the front panel 20.

The link mechanism 200 includes a rotatable link 210 and a long link 220 hinged both on the picture frame panel 30 and the front panel 20, respectively.

The rotatable link 210 is positioned over the long link 220, and both the rotatable link 210 and the long link 220 are hinged so as to be rotatable in an up/down direction.

On the back side of the picture frame base 32 of the picture frame panel 30, there are brackets 212 and 322 projected backward arranged in an up/down direction, and the front panel 20 also has brackets 214 and 324 projected toward the picture frame panel 30 arranged, respectively.

The rotatable link 210 and the long link 220 have one ends 210*a* and 220*a* hinged on the brackets 212 and 322 on the picture frame base 32, and the other ends 210*b* and 220*b* hinged on the brackets 214 and 324 on the front panel 20.

Particularly, the long link 220 is longer than the rotatable link 210.

Moreover, the one ends 210*a* and 220*a* of the rotatable link 210 and the long link 220 are positioned in front of the other ends 210*b* and 220*b* in a state the picture frame panel 30 is in close contact with the front panel 20.

In this instance, by securing a pin 400 to the link mechanism 200, the link mechanism 200, the picture frame panel 30 and the front panel 20 are integrated.

The pin 400 is detachably secured to the link mechanism 200. The pin 400 includes a pin portion 402 for rotatable connection to a link mechanism connection portion 212, and projections 410 and 412 secured to the pin fastening portion 460.

The pin 400 further includes a stopper 404 which is a step at an end of the pin portion 402 for holding the link mechanism connection portion 212 at left/right sides.

The projections 410 and 412 are projected from an outside circumference of the stopper 404 in a radial direction.

A plurality of the projections 410 and 412 are projected from an outside circumference of the stopper 404 at regular intervals in a radial direction, of which one is held by the pin fastening portion 460.

The link mechanism connection portions 212 are the brackets 212*a* and 212*b* spaced with a width greater than a left/right direction width of the link mechanism 200 with opposite pass through holes for pass through of the pin portion 402.

The pin fastening portion 460 is spaced from the link mechanism connection portion 21 greater than the left/right side width of the projections 410.

The pin fastening portion 460 has a pin escaping recess so that the pin 400 is not interfered at the time the pin 400 is placed in a left/right direction at a side of the link mechanism connection portion 212.

There are a projection 464 from one of the pin fastening portion 460 and the projections 410 and 412, and holding holes 414 and 416 in the other one of the fastening portion 460 and the projections 410 and 412 for placing in and holding the projection 464.

For convenience sake, it is assumed that the projection 464 is formed on the pin fastening portion 460, and the holding holes 414 and 416 are formed in the projections 410 and 412 in a left/right direction.

At the picture frame panel 30 and the front panel 20, there are hooks 202 and slots 204 for holding the picture frame panel 30 spaced away in front of the front panel 20.

In the embodiment, the hooks 202 are formed on the back side of the picture frame base 32 on an upper side and sides thereof, and the slots 204 are formed in a front of the front panel 20 at positions opposite to the hooks 202.

As the picture frame panel 30 connected with the link mechanism 200 has a center of gravity in front of the front panel 20, if the picture frame panel 30 is not held by the hooks 202 and slots 204, the picture frame panel 30 is spaced from the front panel 20 by hinge structures of the rotatable link 210 and the long link 220 at a position in front of the front panel 20.

Moreover, the bracket 324 having the other end of the long link 220 connected thereto has rails 225 for slidable up/down movement of the other end 220*b*.

The rails 225 have the hinge 223 at the other end of the long link 220 movably placed therein, and a lower end of the bracket 324 is closed for supporting the long link 220.

Accordingly, the long link 220 is rotatably supported on the lower end of the bracket 324, and can be separated from the bracket 324 by pulling the other end 220*b* of the long link 220 upward if required.

A process for inserting the pin in the link mechanism of the indoor unit of the present invention and a state the link mechanism is operated will be described.

At the time the pin 400 is connected to the link mechanism 200, the pin 400 is positioned at a side of the bracket 212*a* and 212*b*, and a portion of the link mechanism 200 is positioned between the brackets 212*a* and 212*b*, and the pin portion 402 of the pin 400 is passed through the right side bracket 212*b*, the link mechanism 200 and the left side bracket 212*a* in succession.

If the pin portion 402 passes through the right side bracket 212*b*, the link mechanism 200 and the left side bracket 212*a* deeply, the stopper 404 is held by a side of the bracket 212*b*, to limit movement of the pin 400 is a direction of the pass through, thereby rotatably connecting the link mechanism 200 with the pin portion 402.

Thereafter, if the pin 400 is rotated such that one 410 of the projections 410 and 412 are positioned at a side of the pin fastening portion 460, one 410 of the projection 410 and 412 moves between the link mechanism connection portion 212, particularly, the right side bracket 212*b* and the pin fastening portion 460.

At the time of rotation of the pin 400, the projection 410 is brought into contact to, and rides over the projection 464, making at least one of the projection 410 and the pin fastening portion 460 to bend elastically, and to restore elastically as the projection 464 is placed in the holding hole 414 in the projection 410.

That is, by the action of rotating the pin 400 around the pin portion 402, the projection 464 is held by the projection 410, and the pin 400 is secured to the picture frame panel 30 or the base 10 directly without using any separate fastening members, such as screws or the like, simply.

After the pin is connected to the link mechanism thus, if the picture frame panel 30 is pushed close to the front panel 20, such that the picture frame panel 30 rotates while the picture frame panel 30 is held both at the rotatable link 210 and the long link 220, a portion of the picture frame panel 30 connected to the rotatable link 210 and a portion of the picture frame panel 30 connected to the long link 220 rotate at radii different from each other.

Moreover, since the long link 220 is longer than the rotatable link 210, at the time the picture frame panel 30 moves forward, the forward movement of the picture frame panel 30 is restricted by the long link 220 after the one end 210*a* of the rotatable link 210 is rotated by a predetermined angle.

Figure 12:
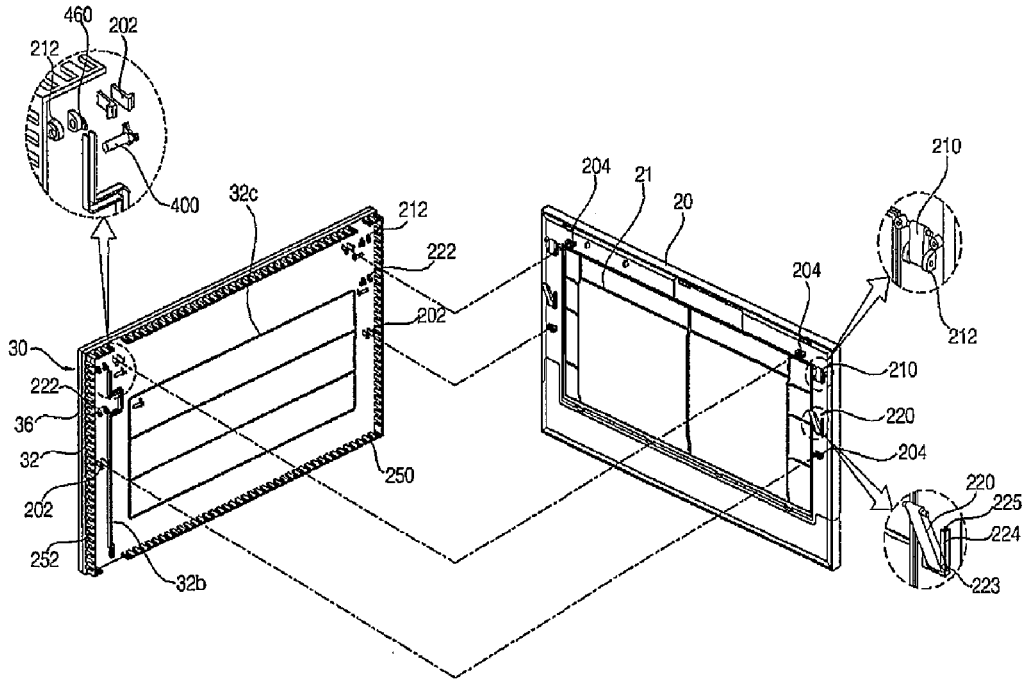
FIG. 12 illustrates an exploded perspective view of a picture frame panel and a link mechanism in accordance with a preferred embodiment of the present invention.
Figure 13:
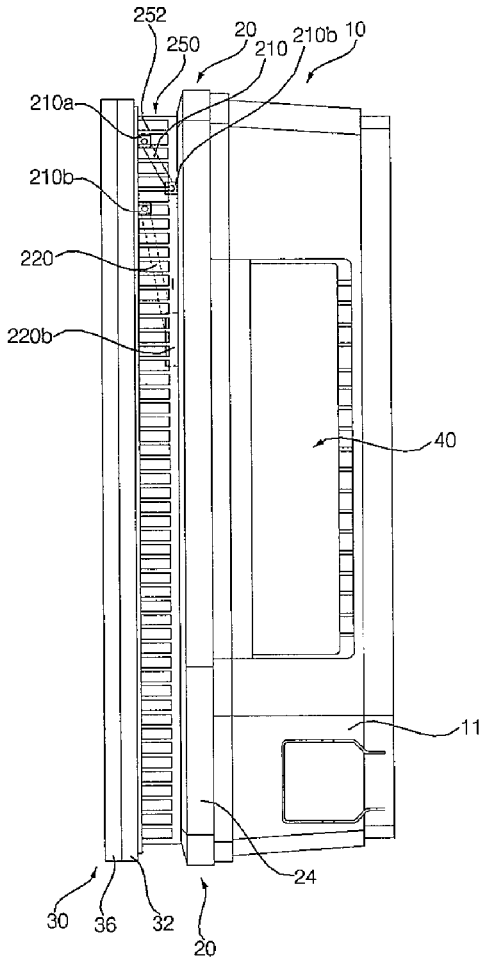
FIG. 13 illustrates a side view of a link mechanism in accordance with a preferred embodiment of the present invention.
Figure 14:
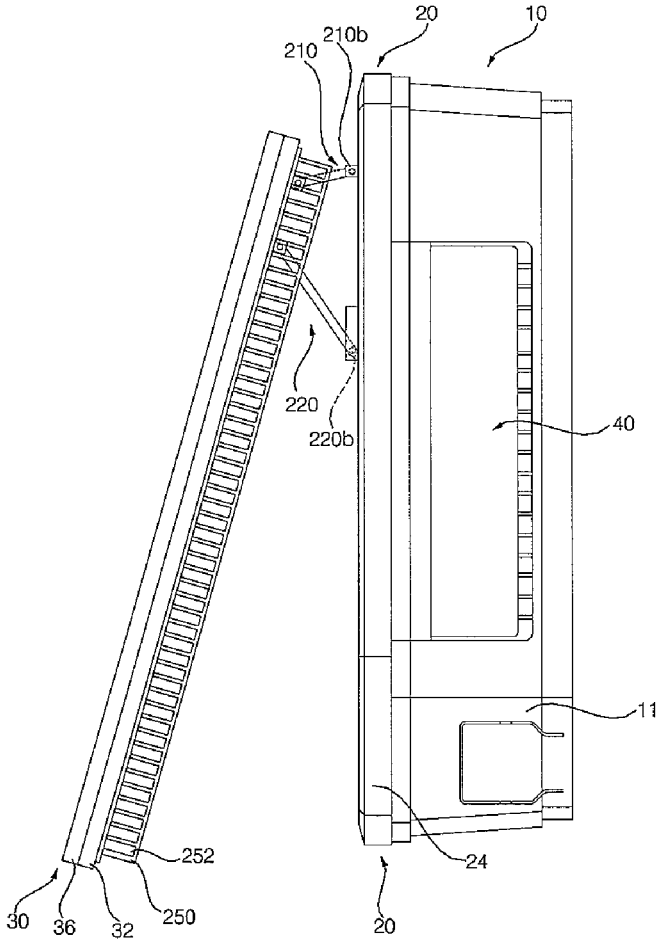
FIG. 14 illustrates a perspective view showing an operation state of a link mechanism in accordance with a preferred embodiment of the present invention.
Figure 15:
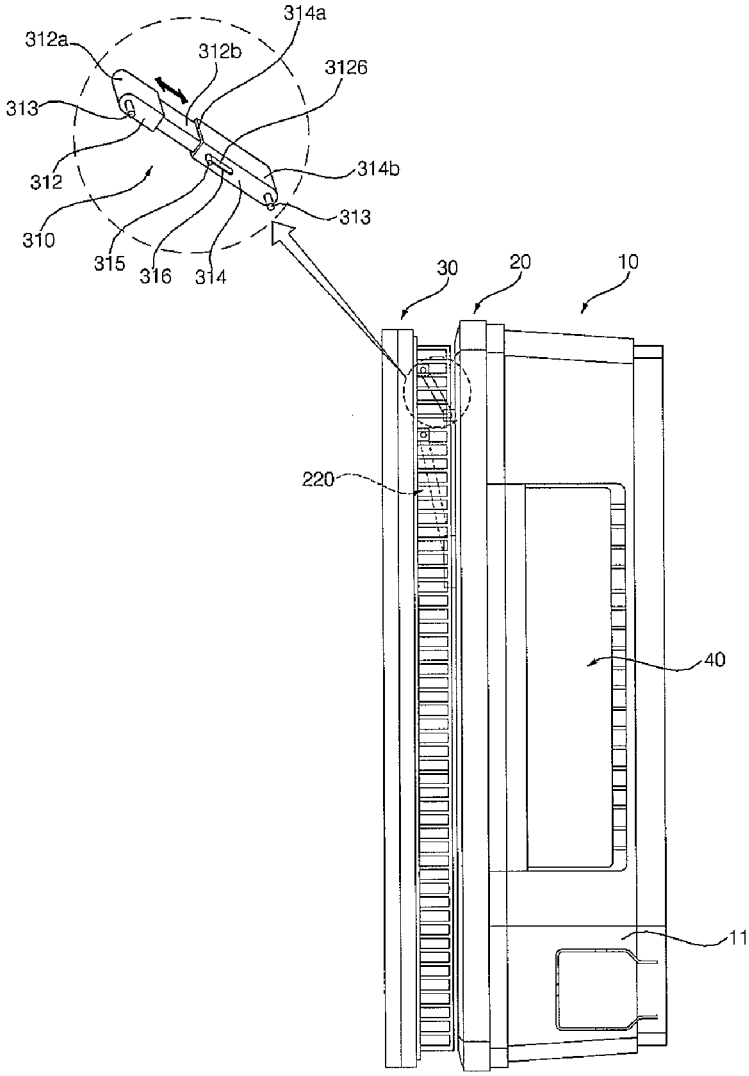
FIG. 15 illustrates a perspective view of an indoor unit having a rotatable link in accordance with a second preferred embodiment of the present invention applied thereto.
Figure 16:
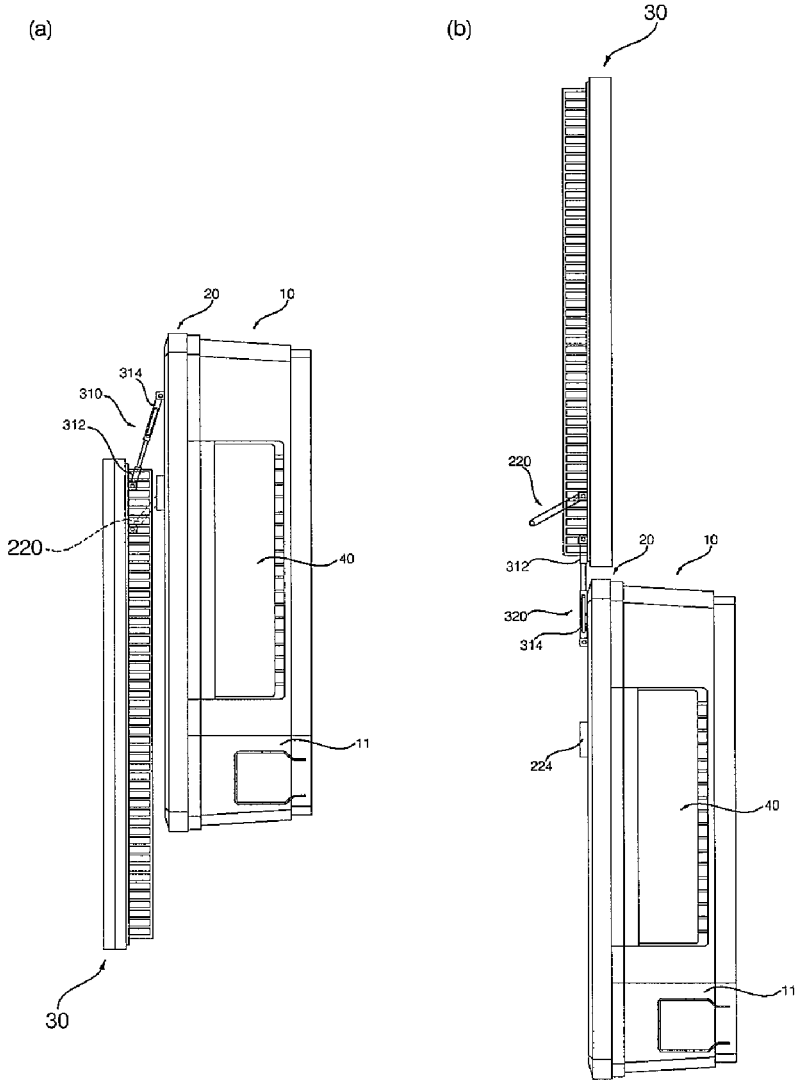
FIG. 16 illustrates an operational diagram showing an operation state of a rotatable link in accordance with a second preferred embodiment of the present invention.
Figure 17:
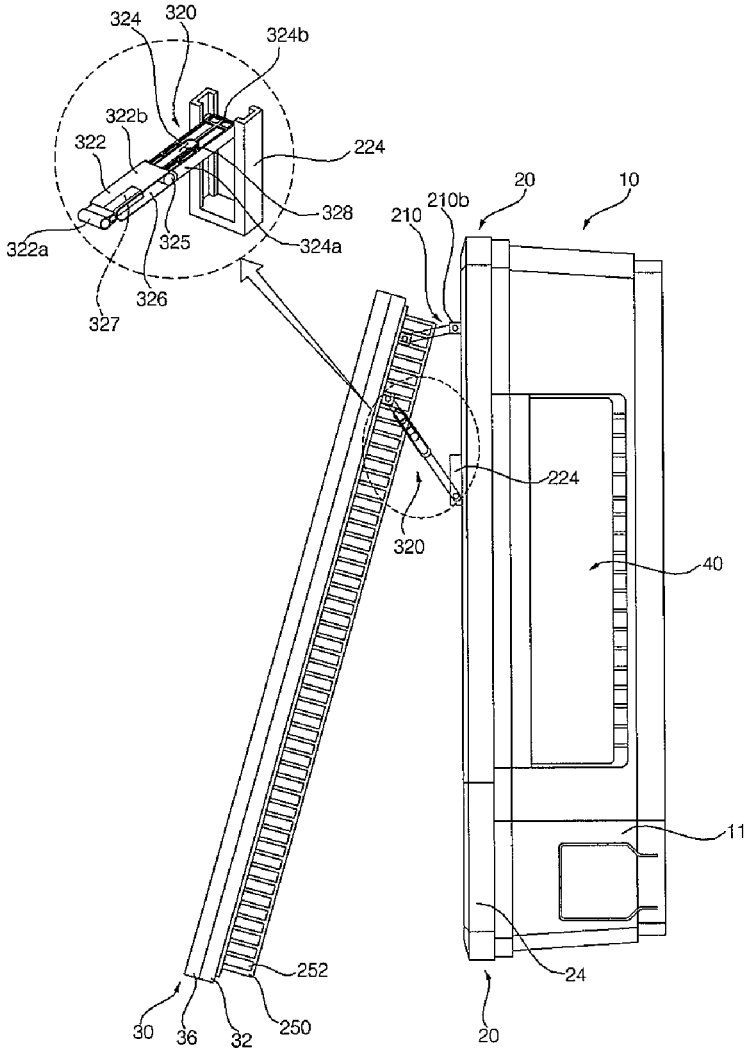
FIG. 17 illustrates a perspective view of an indoor unit having a rotatable link in accordance with a third preferred embodiment of the present invention applied thereto.
Figure 18:
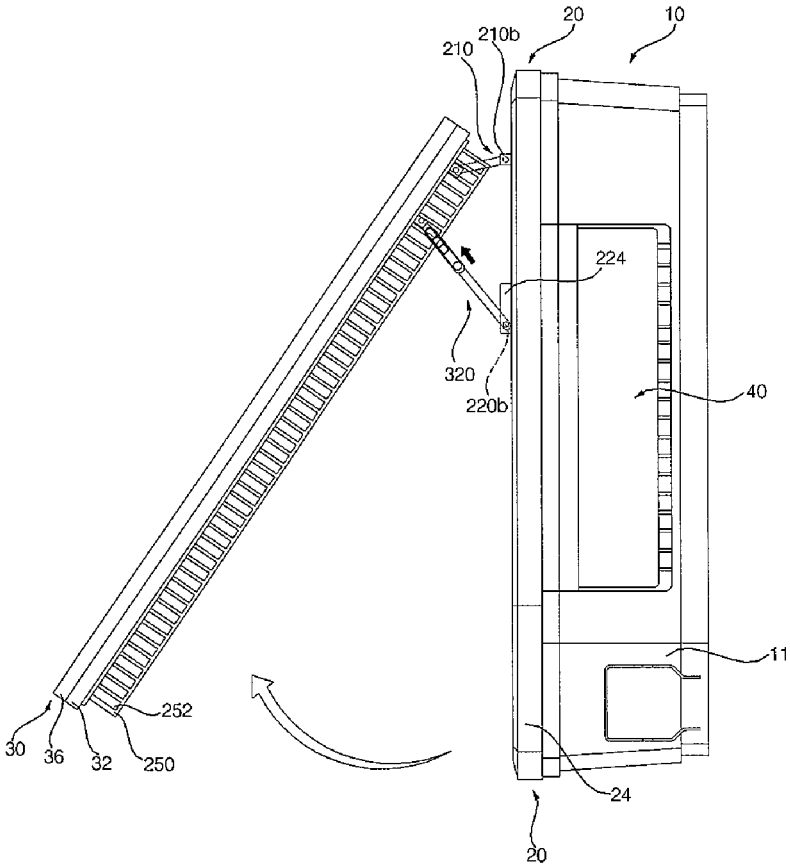
FIG. 18 illustrates an operational diagram showing an operation state of a rotatable link in accordance with a third preferred embodiment of the present invention.
Figure 19:
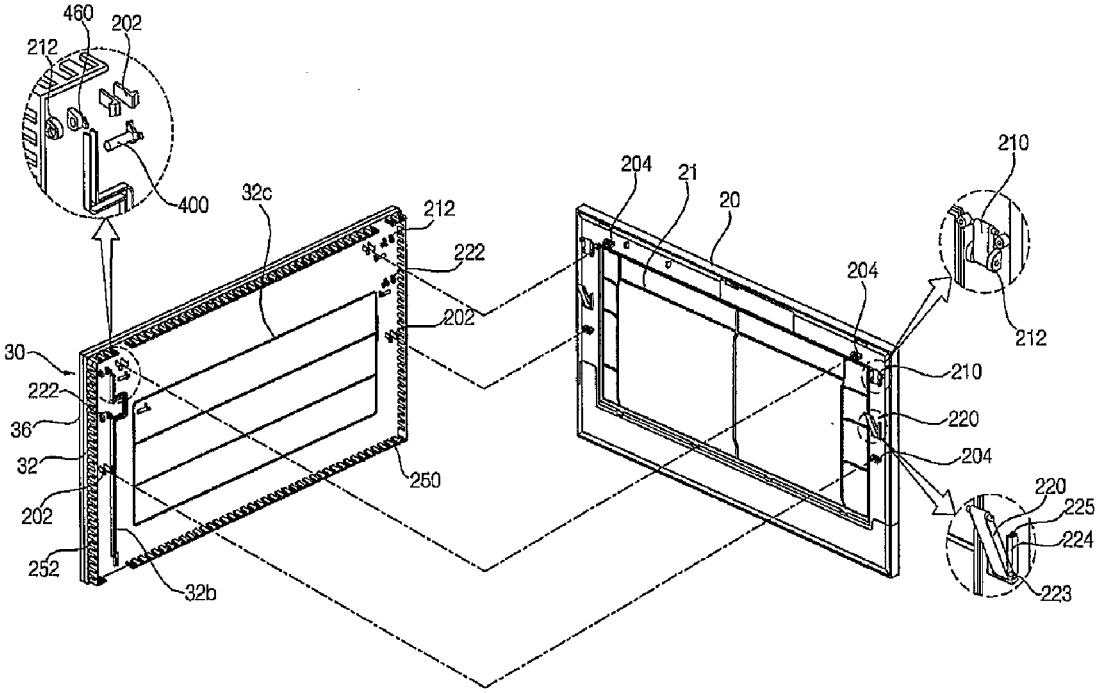
FIG. 19 illustrates an enlarged exploded perspective view of a link mechanism before connection in accordance with a preferred embodiment of the present invention.
Figure 20:
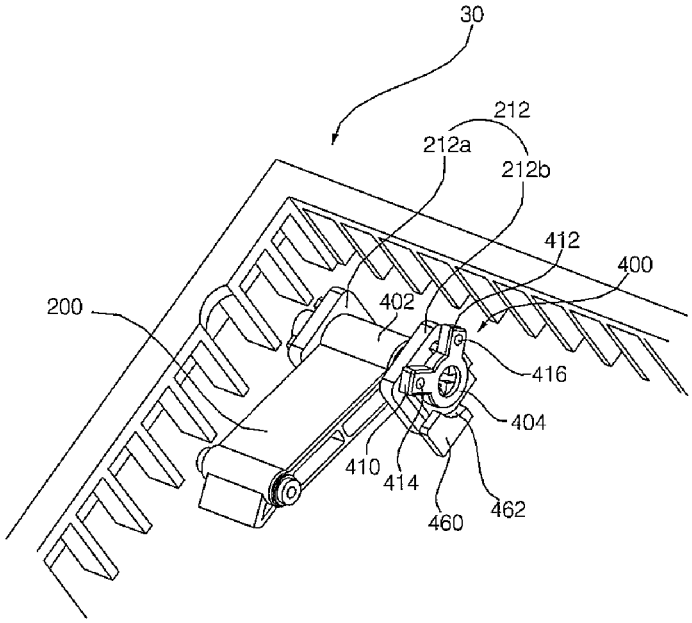
FIG. 20 illustrates an enlarged exploded perspective view of a link mechanism after connection with a pin in FIG. 19 in accordance with a preferred embodiment of the present invention.
Figure 21:
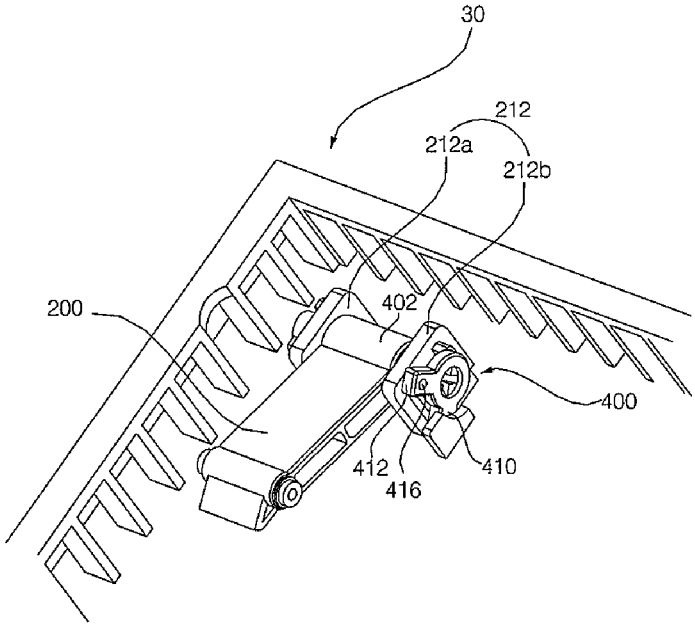
FIG. 21 illustrates an enlarged exploded perspective view when the pin in FIG. 19 is secured in accordance with a preferred embodiment of the present invention.
Figure 22:
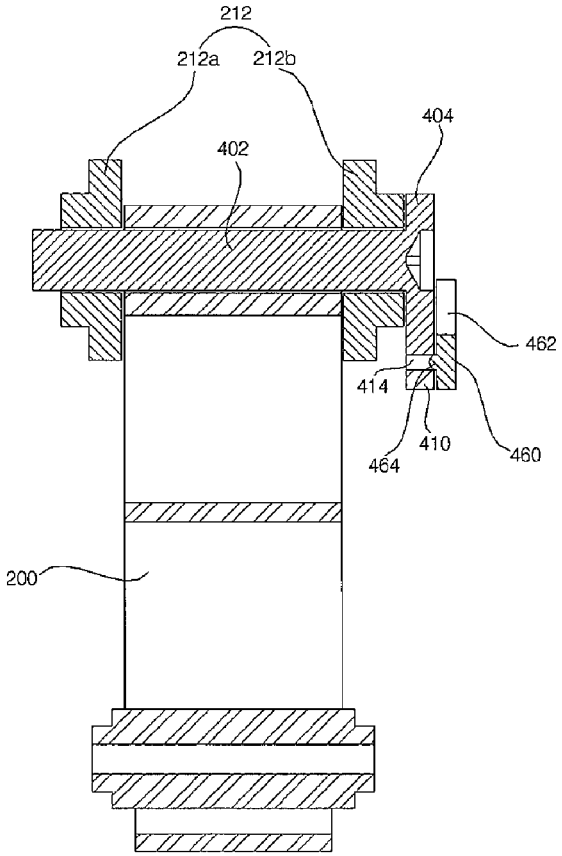
FIG. 22 illustrates an enlarged exploded perspective view when the pin in FIG. 19 is secured in accordance with a preferred embodiment of the present invention.
Figure 23:
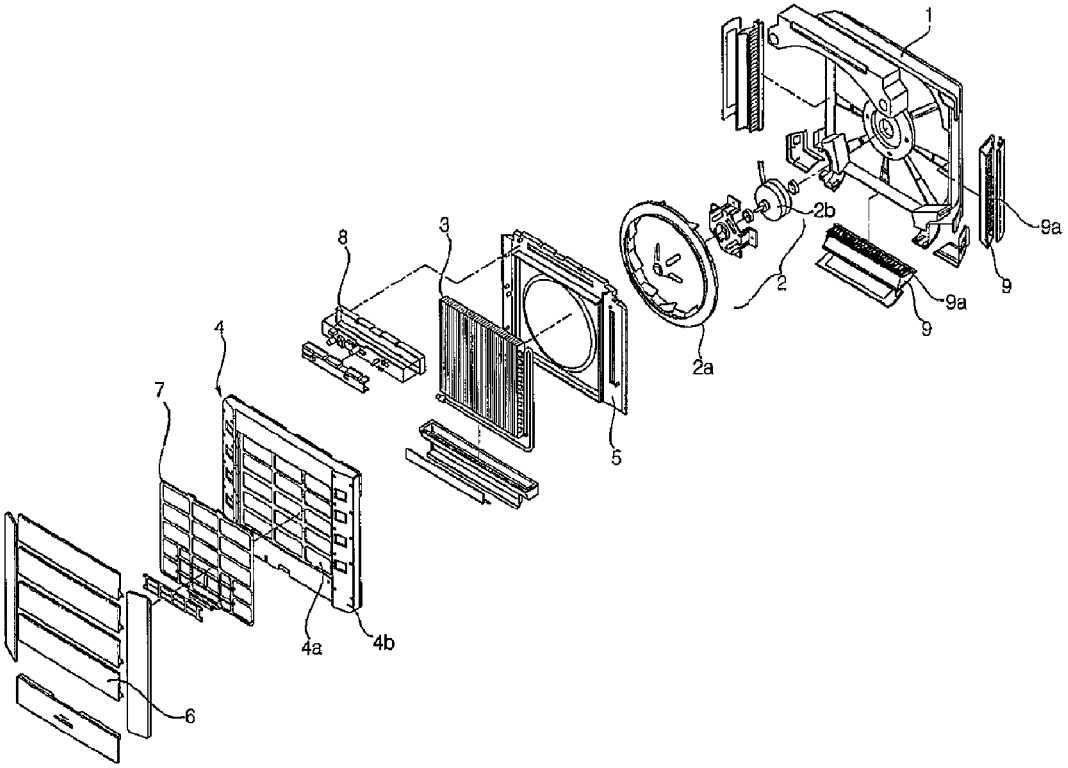
FIG. 23 illustrates an exploded perspective view of a related art air conditioner.

That is, referring to FIG. 12, when the picture frame panel 30 is secured to the front panel 20, the link mechanism 200 is mounted thereto, so that, if the picture frame panel 30 is pulled forward, the holding by the hooks 202 and the slots 204 are released, to rotate the picture frame panel 30 under the restriction of the link mechanism 200 while a center of gravity of the picture frame panel 30 moves.

In more detail, when the picture frame panel 30 starts to move as a moment acts on a center of gravity of the picture frame panel 30, the one end 210*a* of the rotatable link 210 rotates down from an upper side of the bracket 214 to a lower side of the bracket 214, and the one end 220*a* of the long link 220 rotates forward from an upper side of the bracket 324 by a predetermined angle.

Since the rotatable link 210 is shorter than the long link 220, enabling the rotatable link 210 to rotate greater than a rotation angle of the long link 220, the movement of the picture frame panel 30 stops when the one end 210*a* of the rotatable link 210 is positioned lower than a position of the bracket 214 that supports the rotatable link 210.

Accordingly, the user can open the picture frame panel 30 and inspect the filter 60 of the front panel 20 or an inside without supporting the picture frame panel 30.

In the meantime, as the rotation angles of the rotatable link 210 and the long link 220 are dependent on relative lengths of the rotatable link 210 and the long link 220, the rotation angles can be adjusted in a variety of ways, and the spaced distance projected forward can be set in a variety of ways.

Particularly, as far as the one end 220*a* of the long link 220 is not positioned lower than the bracket 224 that supports the long link 220, the picture frame panel 30 is supported on the long link 220, firmly.

When it is required to open the front of the picture frame panel 30, the other end 220*b* of the long link 220 may be detached, for opening the front of the front panel 20.

That is, because the hinge 223 on the other end 220*b* of the long link 220 is placed in the rail 225 of the bracket 224 and an upper side of the bracket 224 is opened, if the other end 220*b* is moved upward, the long link 220 can be detached from the bracket 224 easily as the rotation angle of the rotatable link 210 is adjusted.

In the meantime, though not shown, if the rotatable link arranged on an upper side is longer, the top side of the picture frame panel can be opened wider than the bottom side, which is also acceptable.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As has been described, the indoor unit of an air conditioner of the present invention has the following advantages.

At the time it is intended to dismount the picture frame panel from the cabinet for inspection or repair of the inside of the cabinet, the picture frame panel is not required to dismount completely, and the simple connection of the picture frame panel to the cabinet with the link mechanism permits to increase convenience of assembly work of the indoor unit.

The invention claimed is:

1. An indoor unit of an air conditioner comprising:

a cabinet;

a picture frame panel mounted in front of the cabinet; and a link mechanism hinged both on the cabinet and the picture frame panel, wherein the link mechanism includes a rotatable link and a support link arranged in an up/down direction, and wherein the rotatable link includes a picture frame arm hinged on the picture frame panel, and a panel arm hinged on the cabinet, for adjusting a length by a relative movement of the picture frame arm and the panel arm.

2. The indoor unit as claimed in claim 1, wherein the support link is longer than the rotatable link.

3. The indoor unit as claimed in claim 2, wherein the rotatable link is positioned above the support link.

4. The indoor unit as claimed in claim 1, wherein the picture frame panel has portions the rotatable link/the support link are hinged thereon positioned above portions of the cabinet the rotatable link/the support link are hinged thereon.

5. The indoor unit as claimed in claim 1, wherein the portions of the picture frame panel the support link are hinged thereon are positioned above the portions of the cabinet the support link are hinged thereon.

6. The indoor unit as claimed in claim 1, wherein the cabinet further includes a front panel having the link mechanism connected thereto, and an air inlet in a front thereof, and brackets for hinging the support link or the rotatable link thereon.

7. The indoor unit as claimed in claim 6, wherein the bracket having the support link hinged thereon includes a rail having the hinge of the support link placed therein for moving the support link along the rail.

8. The indoor unit as claimed in claim 7, wherein the bracket has an opened top side and a closed bottom side.

9. The indoor unit as claimed in claim 1, wherein one of the picture frame arm and the panel arm is slidably placed in the other side.

10. The indoor unit as claimed in claim 1, wherein one of the picture frame arm and the panel arm has a guide projection movably placed in a guide groove in the other one of the picture frame arm and the panel arm.

11. The indoor unit as claimed in claim 1, wherein there is a fastening mechanism between the cabinet and the picture frame panel, the fastening mechanism includes a hook on one of the cabinet and the picture frame panel and a hole in the other one of the cabinet and the picture frame panel for placing the hook therein.

12. The indoor unit as claimed in claim 1, further comprising a pin for rotatably connecting the link mechanism to at least one of the case and the picture frame panel, and being held at least the other one of the case and the picture frame panel.

13. The indoor unit as claimed in claim 12, wherein at least one of the case and the picture frame panel includes;

a link mechanism connection portion for rotatable connection of the link mechanism thereto with the pin, and a pin fastening portion for fastening the pin thereto.

14. The indoor unit as claimed in claim 13, wherein the pin includes;

a pin portion passed through the link mechanism connection portion and the link mechanism for rotatable connection of the link mechanism to the link mechanism connection portion and, a projection fastened to the pin fastening portion.

15. The indoor unit as claimed in claim 14, wherein the pin further includes a stopper at an end of the pin portion for being held in a left/right direction by the link mechanism connection portion.

16. The indoor unit as claimed in claim 15, wherein the projection projects from an outside circumference of the stopper in a radial direction.

17. The indoor unit as claimed in claim 14, wherein there are a plurality of the projections formed along the outside circumference of the stopper at intervals.

18. The indoor unit as claimed in claim 14, wherein the link mechanism connection portion is brackets arranged in a left/right direction opposite to each other spaced from each other greater than a left/right direction width of the link mechanism, each having a pass through hole in a left/right direction for pass through of the pin portion.

19. The indoor unit as claimed in claim 14, wherein the pin fastening portion is spaced greater than a left/right direction width of the link mechanism and the projection.

20. The indoor unit as claimed in claim 19, wherein the pin fastening portion has a pin escaping recess for preventing the pin from interfering in a left/right direction at the time the pin is placed in the left/right direction from a side of the link mechanism connection portion.

21. The indoor unit as claimed in claim 14, wherein one of the pin fastening portion and the projection has a projection and the other one of the pin fastening potion and the projection has a holding hole for placing the projection therein to hold the projection.

* * * * *